US010646100B2

(12) United States Patent
Agrawal

(10) Patent No.: US 10,646,100 B2
(45) Date of Patent: May 12, 2020

(54) CONDUIT DOCKING ASSEMBLY FOR A DISHWASHER APPLIANCE

(71) Applicant: Haier US Appliance Solutions, Inc., Wilmington, DE (US)

(72) Inventor: Abhisek Agrawal, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 68 days.

(21) Appl. No.: 15/935,136

(22) Filed: Mar. 26, 2018

(65) Prior Publication Data

US 2019/0290099 A1 Sep. 26, 2019

(51) Int. Cl.

| | |
|---|---|
| ***A47L 15/50*** | (2006.01) |
| ***A47L 15/42*** | (2006.01) |
| *A47L 15/18* | (2006.01) |

(52) U.S. Cl.

CPC ..... *A47L 15/508* (2013.01); *A47L 15/4217* (2013.01); *A47L 15/504* (2013.01); *A47L 15/18* (2013.01)

(58) Field of Classification Search

None

See application file for complete search history.

(56) References Cited

U.S. PATENT DOCUMENTS

| | | | |
|---|---|---|---|
| 5,823,211 | A | 10/1998 | Wilhelmstatter et al. |
| 6,869,029 | B2 | 3/2005 | Ochoa, Sr. et al. |
| 9,480,389 | B2 | 11/2016 | Haft et al. |
| 2013/0068265 | A1 | 3/2013 | Gnadinger et al. |
| 2014/0196756 | A1 | 7/2014 | Dries |

FOREIGN PATENT DOCUMENTS

| | | | |
|---|---|---|---|
| CN | 102008276 | A | 4/2011 |
| DE | 2355271 | A1 | 5/1975 |
| EP | 1935322 | B1 | 5/2013 |

*Primary Examiner* — Eric W Golightly

(74) *Attorney, Agent, or Firm* — Dority & Manning, P.A.

(57) ABSTRACT

An adjustable conduit and docking assembly for use in a dishwasher appliance is provided. The adjustable conduit and docking assembly includes a conduit configured for receiving a docking station at different heights so as to accommodate a height adjustment of a rack assembly to which the conduit is attached. The conduit and docking assembly includes a multiport docking station to provide this functionality.

12 Claims, 10 Drawing Sheets

CONDUIT DOCKING ASSEMBLY FOR A DISHWASHER APPLIANCE

FIELD OF THE INVENTION

The present subject matter relates to a conduit and docking assembly for a dishwasher appliance.

BACKGROUND OF THE INVENTION

Dishwasher appliances generally have a wash chamber that includes one or more racks for the receipt of dishes, pots, pans, and other articles for washing. For example, an upper rack may be provided for glasses, cups, and smaller utensils while a lower rack may be provided for larger items such as pots, pans, and plates. In order to accommodate articles of different sizes, a mechanism for the height adjustment of one or more racks may be provided. One or more upper racks, for example, may be adjustable between different height levels in the dishwasher so that larger items can be placed either into the upper rack by adjusting it to a lower level or into the lower rack by adjusting the upper rack to a higher level. Other configurations for height adjustment of one or more racks may be used as well.

Frequently, one or more fluid conduits may be attached to the bottom of an upper rack in the dishwasher. This conduit may supply fluid to e.g., a spray arm that provides wash fluid at a mid-level location in the dishwasher. For a dishwasher appliance with a front loading door, the racks are typically equipped to slide or roll into and out of the wash chamber so that the user can place or remove articles in the racks. As a result, where a conduit is attached to a movable rack, provision must be made for connecting the conduit with a fluid supply that is usually located toward the rear of the wash chamber. Preferably the connection with a fluid supply will be releasable and self-sealing so that it functions automatically as the user slides the rack assembly in or out of the dishwasher.

Where a rack assembly is height adjustable, challenges are created when providing such a connection for a fluid conduit carried on the rack assembly. These changes in height for the rack necessarily require that the connection point for the fluid conduit will also change height and, therefore, will contact the fluid supply at different locations. One approach to providing such a connection is to provide a docking station having a single docking port to which a conduit attached to the rack assembly may dock. The conduit includes a chamber and a check valve plate having two check valves with closure protrusions extending therefrom. When the conduit is docked in an upper position, one of the check valves is opened to allow a fluid flow into the conduit and the other check valve is closed. In contrast, when the conduit is docked in a lower position, the check valve previously closed is now open and the check valve previously opened is now closed. One challenge with such approach is that the closure protrusions of the check valves obstruct the fluid flow through the chamber despite being into the open position. As a result, the fluid flow to the spray arm is not optimized. Another approach to providing such a connection is to create multiple docking ports each configured for allowing a fluid flow therethrough and each positioned at a predetermined height along a vertically extending fluid supply conduit depending upon the fixed height levels for the rack. This approach requires that each docking port includes a sealing mechanism so that fluid is not released from one port when the conduit is connected to another port at a different level during operation of the dishwasher.

Unfortunately, this can add unwanted complexity to the manufacture, assembly, and operation of the dishwasher.

Accordingly, an adjustable conduit and docking assembly having a conduit carried by a rack in a dishwasher appliance that addresses one or more of the challenges noted above would be beneficial.

BRIEF DESCRIPTION OF THE INVENTION

Aspects and advantages of the invention will be set forth in part in the following description, or may be obvious from the description, or may be learned through practice of the invention.

In one exemplary embodiment, a dishwasher appliance is provided. The dishwasher appliance includes a cabinet defining a wash chamber for the receipt of articles for washing. The dishwasher appliance also includes a rack for carrying the articles, the rack configured for movement between a retracted position and an extended position and configured for adjustment between an upper position and a lower position within the wash chamber. Further, the dishwasher appliance includes a fluid supply located along a rear portion of the wash chamber and defining an egress for a flow of fluid out of the fluid supply. In addition, the dishwasher appliance includes a conduit attached to the rack and movable with the rack between the retracted position and the extended position as well as between the upper position and the lower position, the conduit having a connecting end. The dishwasher appliance also includes a chamber positioned at the connecting end of the conduit. The chamber defining an opening. The dishwasher appliance further includes a sealing plate positioned at the opening of the chamber and defining an upper aperture and a lower aperture. In addition, the dishwasher appliance includes a docking station attached to the fluid supply, the docking station having an upper docking port, a middle docking port, and a lower docking port, the upper aperture and the lower aperture of the sealing plate each configured to receive one of the upper, middle, and lower docking ports when the rack is in the retracted position, and wherein the middle docking port has an opened end to permit the flow of fluid through the egress and into the conduit when the rack is in the retracted position and wherein the upper docking port and the lower docking port each have a closed end to prevent the flow of fluid into the conduit when the rack is in the retracted position.

In another exemplary embodiment, an adjustable conduit and docking assembly for use in a dishwasher appliance is provided. The adjustable conduit and docking assembly includes a docking station in fluid communication with a fluid supply. The docking station includes a housing. The docking station further includes an upper docking port protruding from the housing and having a closed end. The docking station also includes a lower docking port protruding from the housing and having a closed end. Further, the docking station includes a middle docking port protruding from the housing and having an opened end and positioned between the upper docking port and the lower docking port. The adjustable conduit and docking assembly also includes a conduit movable between an upper position and a lower position, the conduit having a connecting end. The adjustable conduit and docking assembly also includes a chamber positioned at the connecting end of the conduit and defining an opening. Further, the adjustable conduit and docking assembly includes a sealing plate positioned at the opening of the chamber and defining an upper aperture and a lower aperture, wherein when the conduit is docked with the docking station and: i) the conduit is in the upper position, the lower aperture is configured to receive the middle docking port such that the fluid supply is in fluid communication with the conduit and the upper aperture is configured to receive the upper docking port; and ii) the conduit is in the lower position, the upper aperture is configured to receive the middle docking port such that the fluid supply is in fluid communication with the conduit and the lower aperture is configured to receive the lower docking port.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

The use of the same or similar reference numerals in the figures indicates identical or similar features.

DETAILED DESCRIPTION OF THE INVENTION

Figure 1:
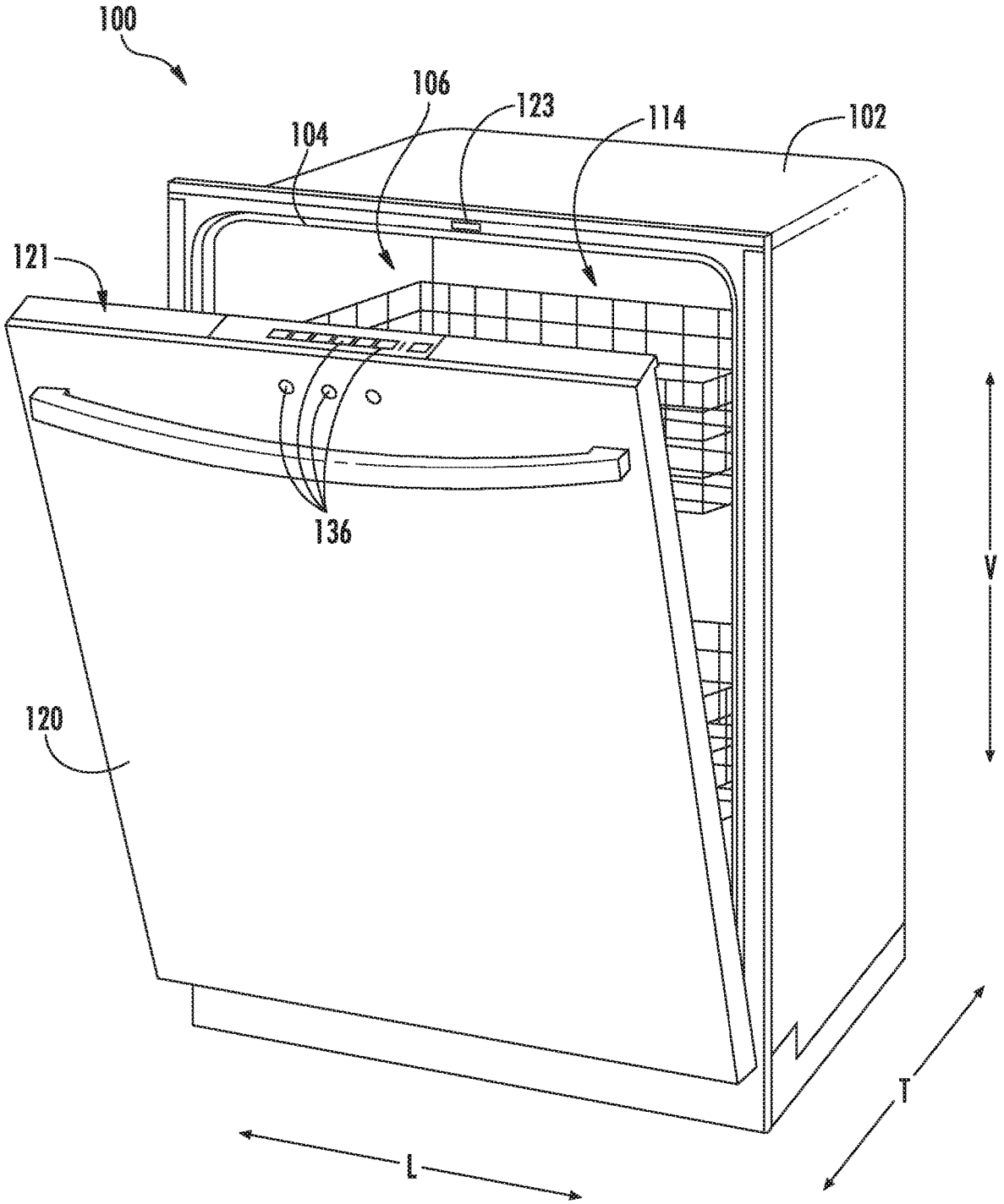
FIG. 1 provides a front view of an exemplary embodiment of a dishwasher appliance according to various embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent (10%) margin of error.

Figure 2:
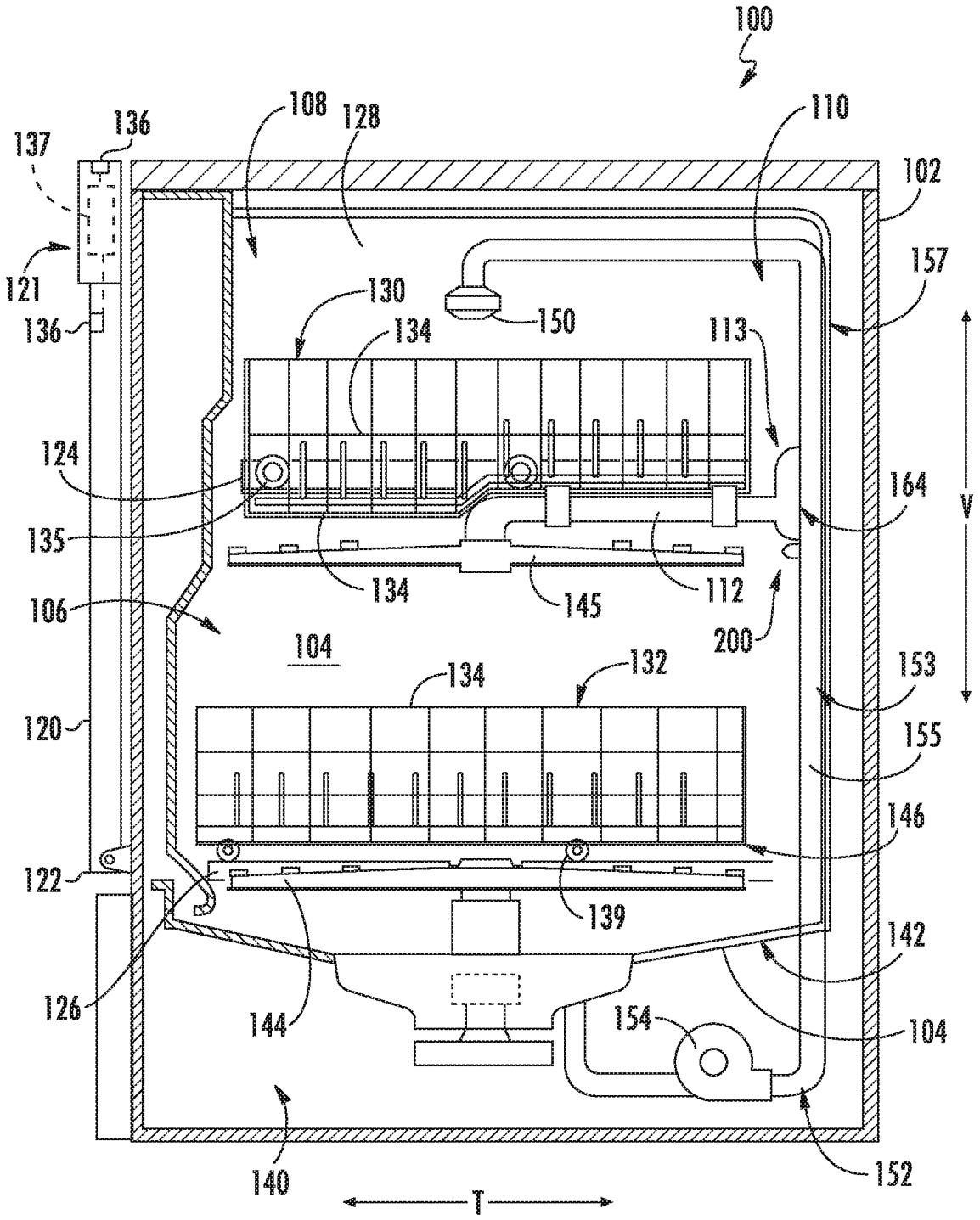
FIG. 2 provides a cross-sectional view of the dishwasher appliance of FIG. 1.

FIGS. 1 and 2 depict an exemplary dishwasher appliance 100 that may be configured in accordance with aspects of the present disclosure. Dishwasher appliance 100 defines a vertical direction V, a lateral direction L and a transverse direction T. The vertical, lateral, and transverse directions V, L, and T are mutually perpendicular and form an orthogonal direction system. Dishwasher 100 includes a cabinet 102 having a tub 104 that together define a wash chamber 106. Wash chamber 106 extends between a front portion 108 and a rear portion 110, e.g., along the transverse direction T. The wash chamber 106 includes a front opening 114 (FIG. 1) and a door 120 hinged at its bottom 122 for movement between a normally closed vertical position (FIG. 2), wherein the wash chamber 106 is sealed shut for washing operation, and an open position (FIG. 1) for loading and unloading of articles from dishwasher appliance 100. Latch 123 (FIG. 1) is used to lock and unlock door 120 for access to wash chamber 106.

As shown in FIG. 2, upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIG. 2) in which the rack is located inside wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

Upper rack assembly 130 is movable between a lower level and upper level along the vertical direction V. As such, a user can adjust the vertical level of upper rack assembly 130 to accommodate larger utensils either in rack 130 or below in rack 132. In this way, upper rack assembly 130 is an adjustable rack assembly. A variety of mechanisms can be provided to allow for such adjustment of the rack assembly between levels as will be understood by one of skill in the art such that further description thereof is unnecessary.

Dishwasher appliance 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 145 is located in an upper region of the wash chamber 106 and is attached to, connected with, or integrated with upper rack 130. As upper rack 130 is slid in and out of wash chamber 106 (i.e., between a retracted position and an extended position), mid-level spray arm assembly 145 moves with the rack 130 along with a conduit 112 that provides wash or rinse fluids to mid-level spray-arm assembly 145 from a fluid supply 153. Conduit 112 includes a connecting end 113 that is oriented towards the rear wall of cabinet 102. Additionally, an upper spray assembly 150 may be located above the upper rack 130.

The lower and mid-level spray-arm assemblies 144, 145 and the upper spray assembly 150 are fed by a fluid circulation system 152 that provides for circulating wash fluids (e.g., water, water and detergent) within chamber 106. The fluid circulation assembly 152 includes a pump 154 located in a machinery compartment 140 below the bottom sump portion 142 of the tub 104, as generally recognized in the art. Pump 154 is connected to fluid supply 153 that, for this embodiment, is constructed as vertically oriented conduit 155 that extends along the rear wall 157 of chamber 106. Each spray-arm assembly 144, 145 includes an arrangement of discharge ports or orifices for directing washing liquid onto dishes or other articles located in rack assemblies 130 and 132. The arrangement of the discharge ports in spray-arm assemblies 144, 145 provides a rotational force by virtue of washing fluid flowing through the discharge ports. For example, the resultant rotation of the lower spray-arm assembly 144 provides coverage of dishes and other dishwasher contents with a washing spray.

Dishwasher appliance 100 is further equipped with a controller 137 to regulate operation of dishwasher appliance 100. Controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 137 may be positioned in a variety of locations throughout dishwasher appliance 100. In the illustrated embodiment, controller 137 is located proximate a control panel assembly 121 as shown. In such an embodiment, input/output ("I/O") signals may be routed between the control system and various operational components of dishwasher appliance 100 along wiring harnesses that may be routed through the bottom 122 of door 120. Control panel assembly 121 of dishwasher appliance 100 includes various input selectors 136 through which a user may select various operational features and modes and monitor progress of dishwasher appliance 100. In some embodiments, input selectors 136 may represent a general purpose I/O ("GPIO") device or functional block. In some embodiments, input selectors 136 may include input components, such as one or more of a variety of electrical, mechanical or electro-mechanical input devices including rotary dials, push buttons, and touch pads. Control panel assembly 121 may also include a display component, such as a digital or analog display device designed to provide operational feedback to a user. The various components of control panel assembly may be communicatively coupled with controller 137 via one or more signal lines, shared communication busses, or via a wireless connection.

It should be appreciated that the invention is not limited to any particular style, model, or other configuration of dishwasher, and that the embodiment depicted in FIGS. 1 and 2 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles. In addition, more than two racks—including multiple upper racks—may also be constructed. Other configurations may be used as well.

Figure 3:
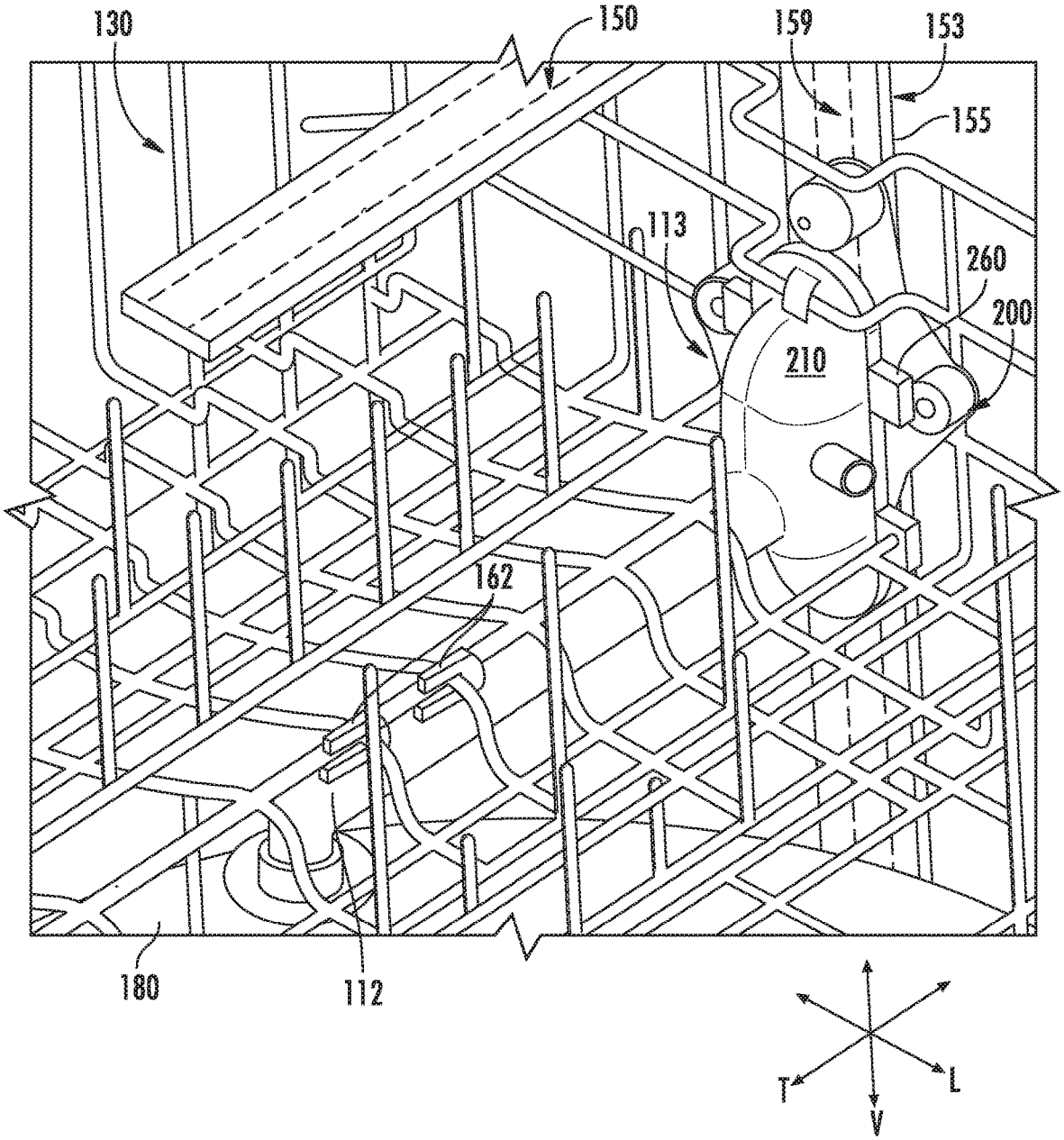
FIG. 3 provides a perspective view of an exemplary adjustable conduit and docking assembly according to various embodiments of the present disclosure.
Figure 4:
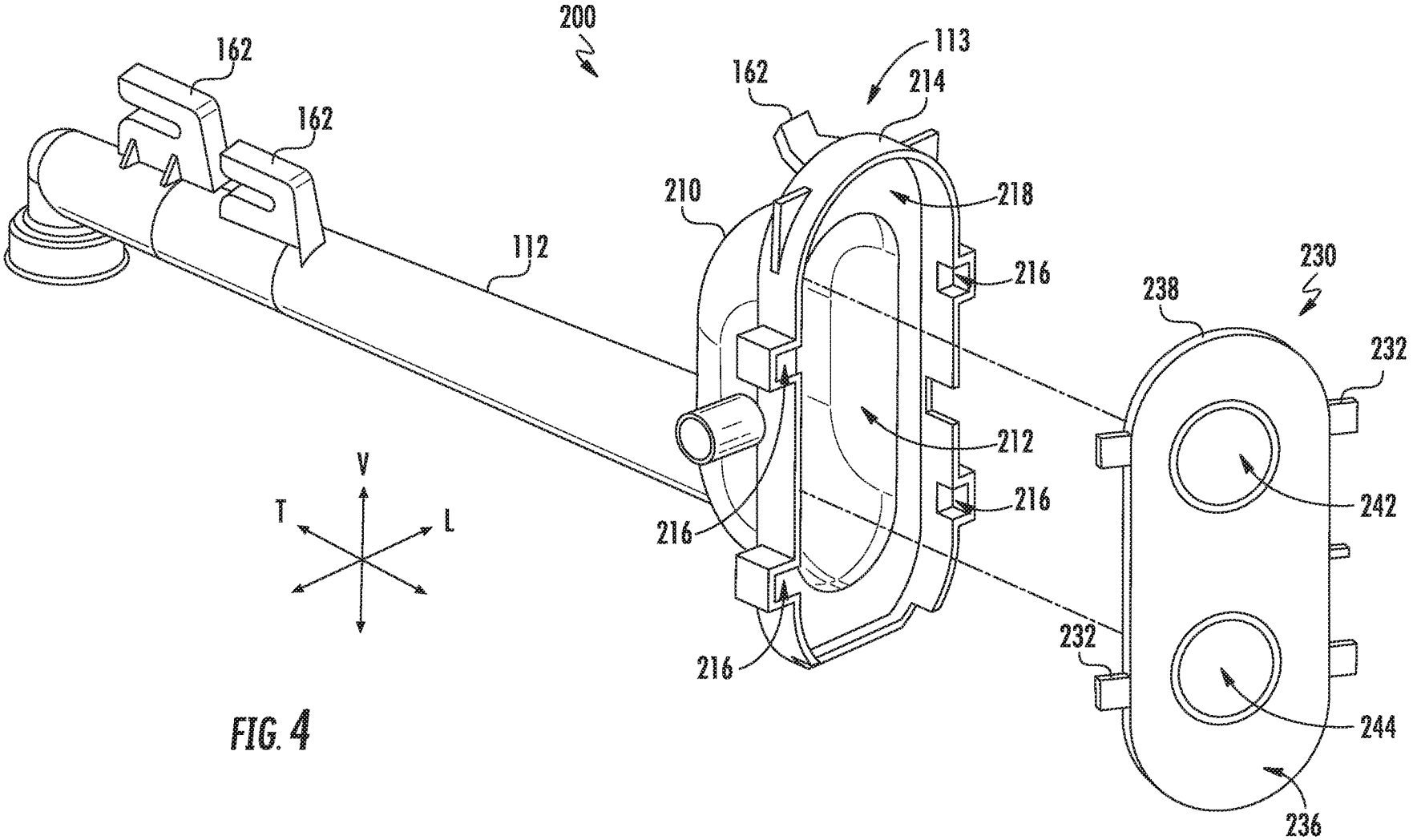
FIG. 4 provides an exploded view of the adjustable conduit and docking assembly of FIG. 3.
Figure 6:
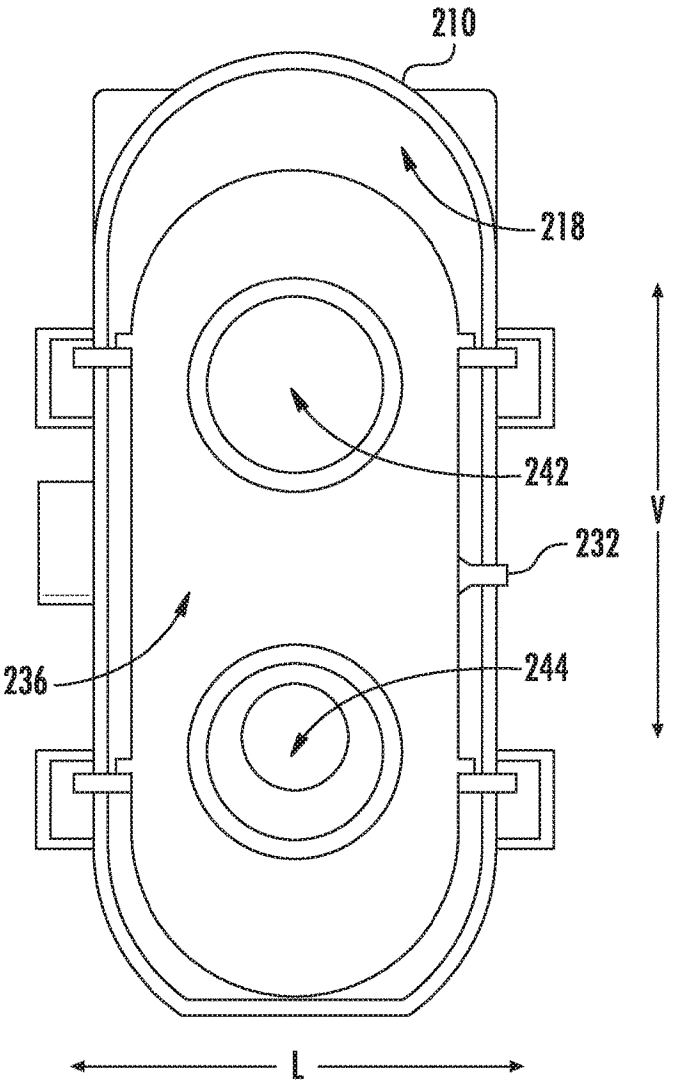
FIG. 6 provides a close up view of the sealing plate mounted to a chamber of the adjustable conduit and docking assembly of FIG. 3.
Figure 5:
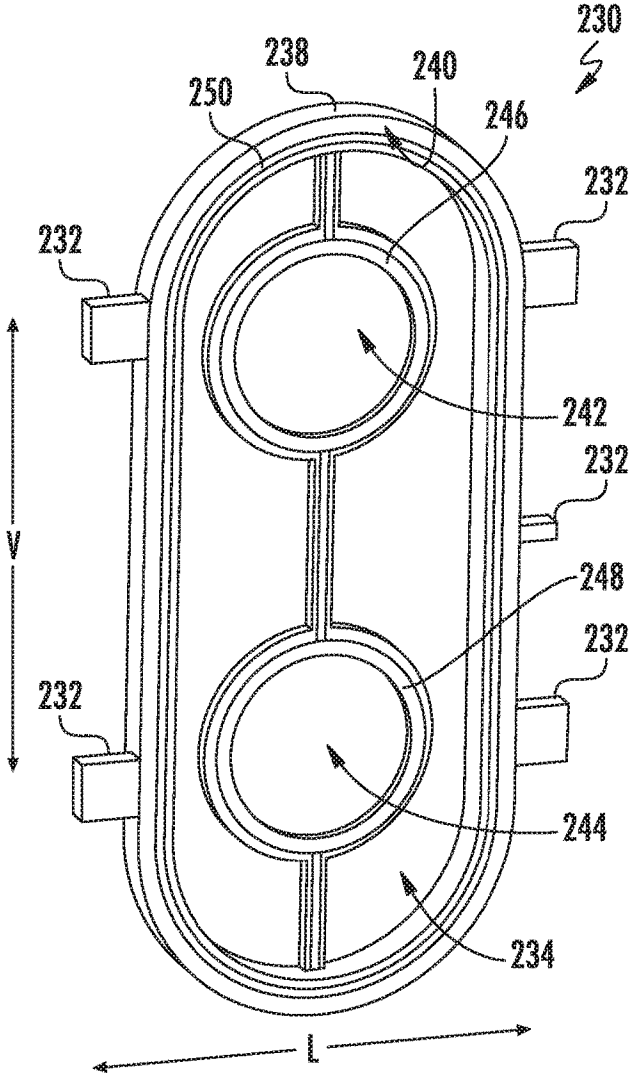
FIG. 5 provides a perspective view of a sealing plate of the adjustable conduit and docking assembly of FIG. 3.
Figure 7:
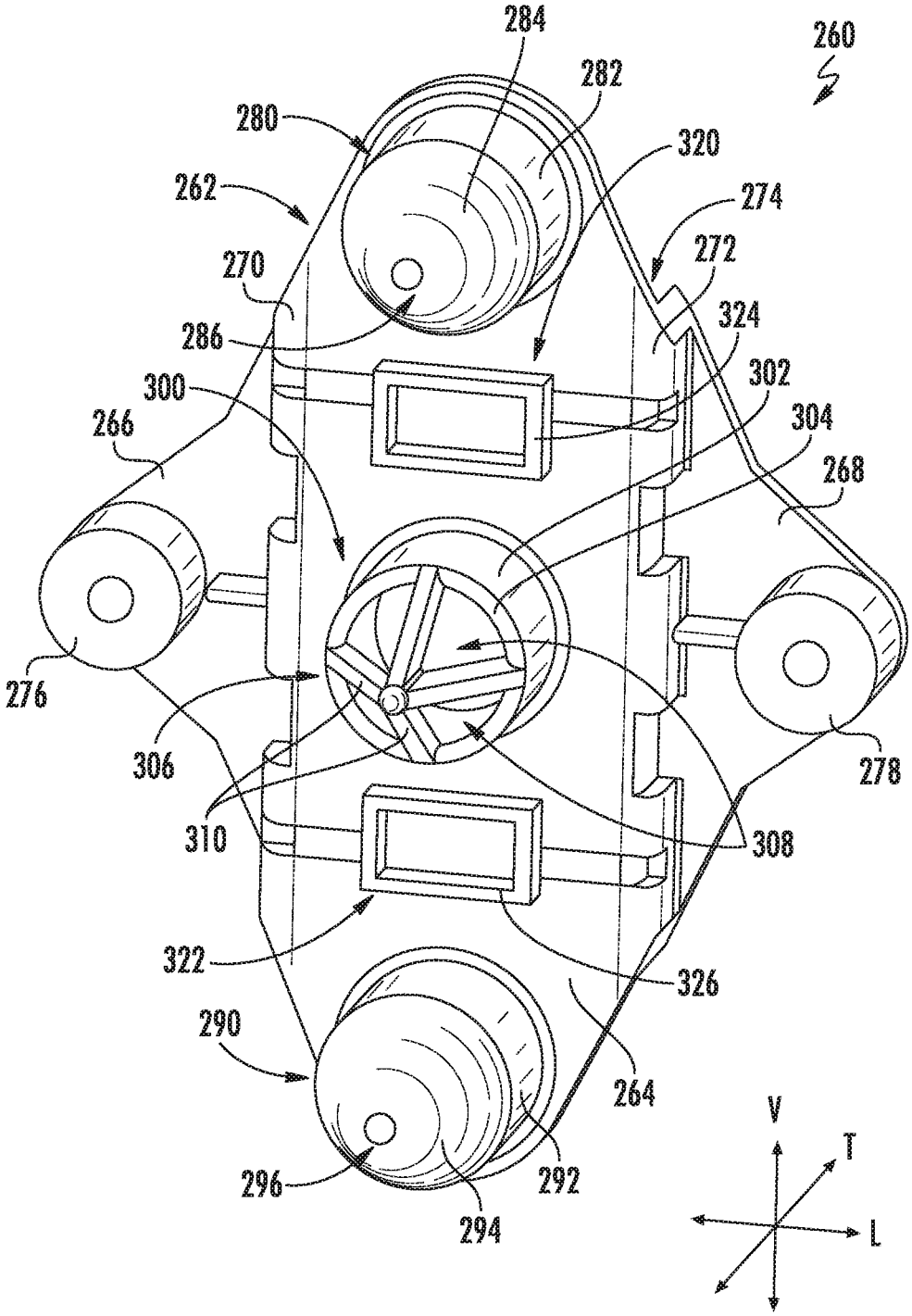
FIG. 7 provides a perspective view of a docking station of the adjustable conduit and docking assembly of FIG. 3.

FIGS. 3 through 7 provide an exemplary adjustable conduit and docking assembly 200 and its various components according to exemplary embodiments of the present disclosure. In particular, FIG. 3 provides a perspective view of conduit and docking assembly 200. FIG. 4 provides an exploded view of conduit and docking assembly 200. FIG. 5 provides a perspective view of a sealing plate of adjustable conduit and docking assembly 200. FIG. 6 provides a close up view of the sealing plate mounted to a chamber of the adjustable conduit and docking assembly 200. FIG. 7 provides a perspective view of a docking station of the adjustable conduit and docking assembly 200. Conduit and docking assembly 200 may be mid-level spray arm assembly 145 for use with dishwasher appliance 100 of FIGS. 1 and 2, for example. As shown, generally, conduit and docking assembly 200 includes a docking station 260 (FIGS. 3 and 7) attached to a front wall 159 of fluid supply 153 (FIG. 3), a sealing plate 230 (FIGS. 4, 5, 6), conduit 112 (FIGS. 3 and 4), and a spray arm 180 (FIG. 3) in fluid communication with conduit 112. Adjustable conduit and docking assembly 200 will be explained more fully below.

Figure 10:
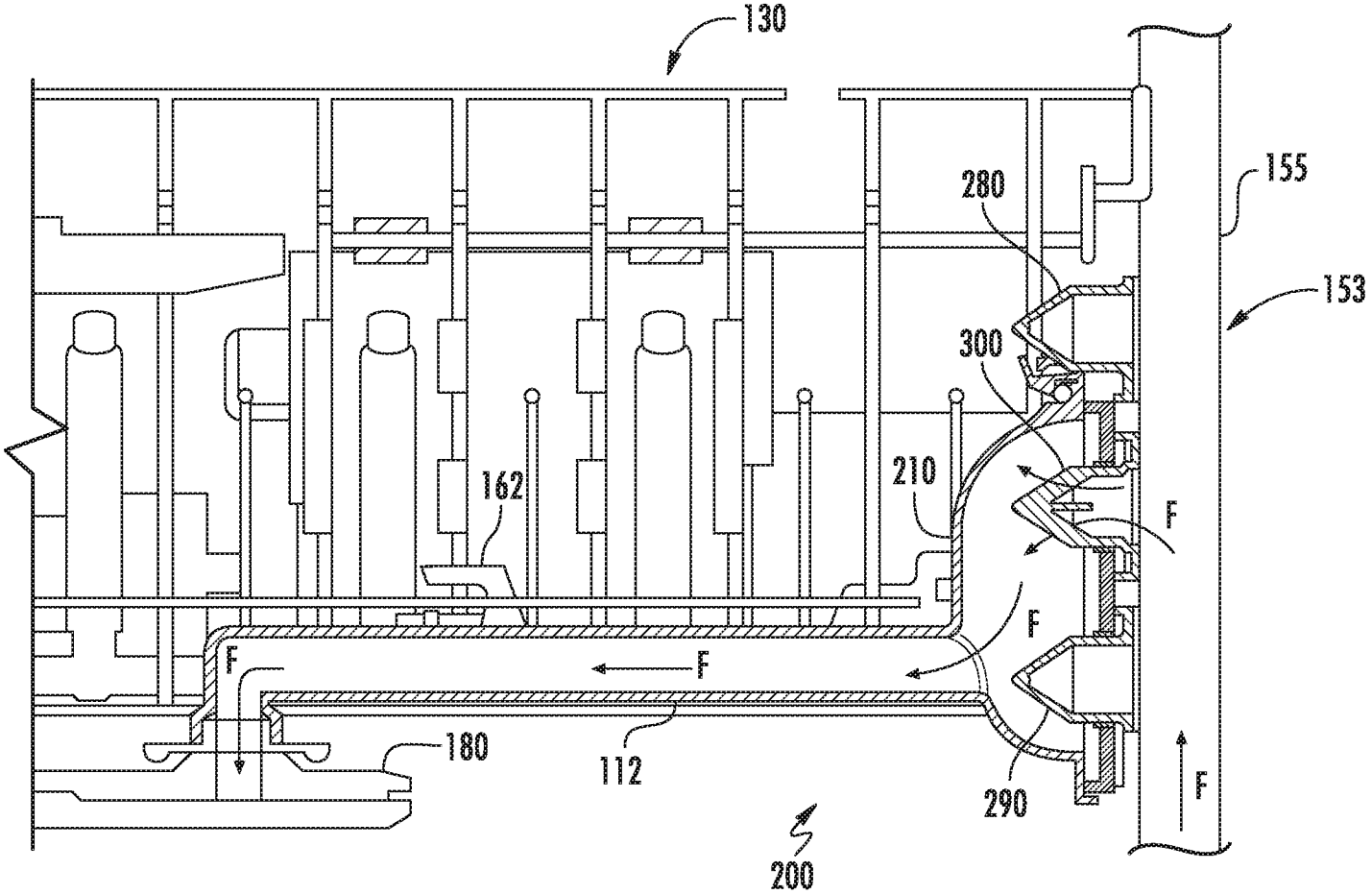
FIG. 10 provides a side, cross sectional view of the adjustable conduit and docking assembly of FIG. 3 in a lower position.
Figure 11:
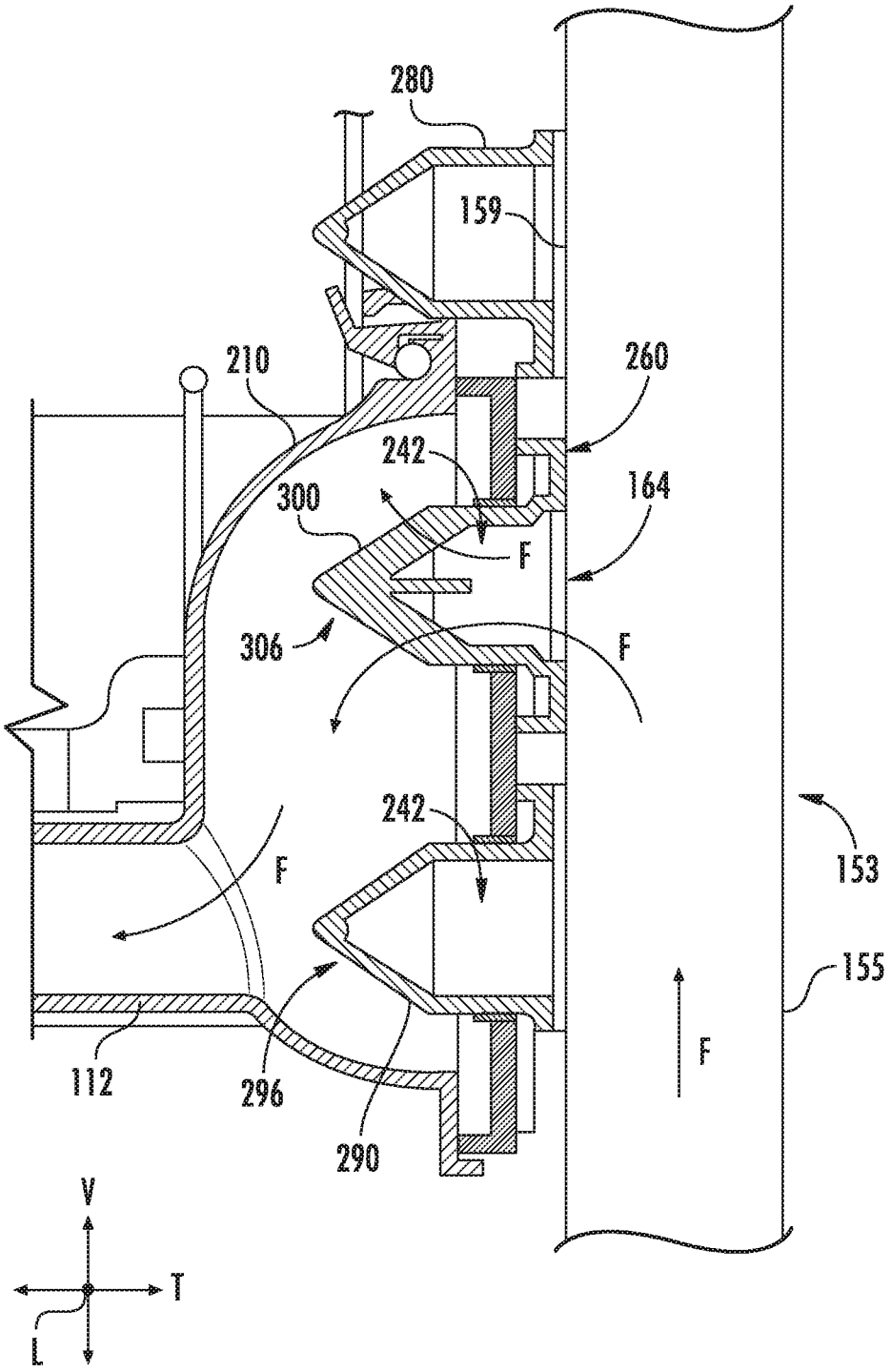
FIG. 11 provides a close up, cross sectional of Section 11 of FIG. 10.

As upper rack assembly 130 is movable between an upper position and a lower position along the vertical direction V, conduit and docking assembly 200 attached thereto (e.g., via a snap lock 160 and a plurality of hooks 162) must be capable of docking with docking station 260 at two or more elevations, e.g., along the vertical direction V. Accordingly, conduit and docking assembly 200 includes a chamber 210 that is positioned at connecting end 113 of conduit 112. Chamber 210 is capable of docking with docking station 260 at two different elevations, including an upper position (FIGS. 8 and 9) and a lower position (FIGS. 10 and 11). For this embodiment, chamber 210 is integrally formed with conduit 112 such that conduit 112 and chamber 210 are formed as a unitary, continuous piece. In some alternative embodiments, chamber 210 and conduit 112 are separate pieces and chamber 210 is attached to conduit 112 at connecting end 113.

Further, as shown best in FIG. 4, chamber 210 defines an opening 212. In particular, a chamber fringe 214 of chamber 210 defines opening 212. Opening 212 opens toward rear portion 110 of wash chamber 106 (FIG. 2). Slots 216 are positioned about the perimeter of chamber fringe 214 and provide for secure mounting of sealing plate 230 to chamber 210 at opening 212. In particular, sealing plate 230 includes clips 232 that each correspond with one of the slots 216 of chamber 210. The clips 232 of sealing plate 230 are inserted into their corresponding slots 216 to position sealing plate 230 at opening 212 of chamber 210. Chamber 210 includes a recessed face 218 that has an annular or ring-like shape and a face that extends orthogonal to the transverse direction T.

Recessed face 218 is spaced from opening 212 of chamber 210, e.g., along the transverse direction T. When sealing plate 230 is assembled with chamber 210 (as shown in FIG. 6), a forward surface 240 of a rim 238 of sealing plate 230 (FIG. 5) is seated or pressed flush with recessed face 218 of chamber 210. As such, opening 212 of chamber 210 is sized to receive sealing plate 230.

As depicted best in FIG. 5, for this exemplary embodiment, sealing plate 230 has an oval shape and is configured to be positioned at opening 212 of chamber 210, as noted above. Sealing plate 230 has a forward surface 234 and an opposing rear surface 236 (FIGS. 4 and 6). Forward surface 234 is recessed relative to forward surface 240 of rim 238, e.g., along the transverse direction T. Rim 238 extends about a perimeter of sealing plate 230 as shown. Notably, sealing plate 230 defines an upper aperture 242 and a lower aperture 244. Upper aperture 242 is spaced from lower aperture 244, e.g., along the vertical direction V. For this embodiment, upper aperture 242 and lower aperture 244 each have circular shapes, however, other shapes are possible. Further, upper aperture 242 and lower aperture 244 are each sized to receive one of the docking ports of docking station 260, as will be explained more fully below.

A sealing member 246 is disposed about upper aperture 242. Likewise, a sealing member 248 is disposed about lower aperture 244. Sealing members 246, 248 may be attached to sealing plate 230 in any suitable manner. For example, sealing members 246, 248 may be overmolded to sealing plate 230 about their respective apertures 242, 244. When conduit 112 is docked with docking station 260, sealing members 246, 248 seal around respective docking ports of docking station 260 to prevent leakage therefrom. Sealing members 246, 248 may be any suitable material capable of performing such sealing tasks, e.g., a rubber material. In addition, a sealing member 250 or gasket is disposed about rim 238. In particular, for this embodiment, sealing member 250 is overmolded to rim 238. When conduit 112 is docked with docking station 260, sealing member 250 is pressed against recessed face 218 to prevent leakage from chamber 210.

As shown particularly in FIG. 7, docking station 260 includes a housing 262. Housing 262 includes a main body 264 and mounting wings 266, 268 disposed on each side of main body 264. Main body 264 is attached to mounting wings 266, 268 by respective ridges 270, 272. Notably, main body 264 is positioned forward of mounting wings 266, 268, e.g., along the transverse direction T, so that main body 264 and ridges 270, 272 define a channel 274. Channel 274 is sized to receive a portion of fluid supply 153 when docking station 260 is mounted within dishwasher appliance 100, e.g., as shown in FIG. 3. Each mounting wing 266, 268 includes a mounting structure 276, 278 that facilitate mounting of docking station 260, e.g., to rear wall 157 of tub 104 (FIG. 2) or to fluid supply 153 (FIG. 3).

For this exemplary embodiment, docking station 260 includes an upper docking port 280, a middle docking port 300, and a lower docking port 290. Each docking port 280, 300, 290 protrudes from housing 262, e.g., along the transverse direction T. More particularly, upper port 280, middle port 300, and lower port 290 each protrude from main body 264 of housing 262 towards front portion 108 of wash chamber 106 (FIG. 2). In this way, the docking ports 280, 300, 290 are each configured to receive one of the apertures 242, 244 of sealing plate 230 when conduit 112 is docked with docking station 260. Middle port 300 is positioned between upper port 280 and lower port 290, e.g., along the vertical direction V. Each docking port 280, 300, 290 has a base protrusion and a conical protrusion. As depicted in FIG. 7, upper port 280 has a base protrusion 282 and a conical protrusion 284 extending therefrom, lower port 290 has a base protrusion 292 and a conical protrusion 294 extending therefrom, and middle port 300 has a base protrusion 302 and a conical protrusion 304 extending therefrom formed by a plurality of frame members 310. The base protrusions 282, 292, 302 of docking ports 280, 290, 300 protrude or project outward from main body 264, e.g., along the transverse direction T, and each base protrusion has a generally cylindrical shape. The conical protrusions 284, 294, 304 of the docking ports 280, 290, 300 each extend from their respective base protrusions toward front portion 108 of wash chamber 106 (FIG. 2). The conical protrusions 284, 294, 304 may each have a conical or conical frustum shape. In alternative exemplary embodiments, the protrusions extending from the base protrusions of the docking ports may have other geometries as well, such as e.g., cylindrical shape, a coniptical shape (i.e., a combination conical and elliptical shape), a pyramid shape, etc.

Referring still to FIG. 7, as shown, upper and lower ports 280, 290 each have closed ends 286, 296, respectively. Stated differently, there is no ingress or egress from the volume defined by the upper and lower ports 280, 290. Thus, fluid is prevented from flowing through the closed ends 286, 296 of upper and lower docking ports 280, 290, respectively. In contrast, middle port 300 has an opened end 306. In particular, middle port 300 defines a plurality of openings 308 at its opened end 306. For this embodiment, frame members 310 form conical protrusion 304 of middle port 300 and are spaced from one another so as to define the openings 308. Accordingly, during operation of dishwasher appliance 100, fluid may flow through egress 164 of fluid supply 153 (FIG. 2), through the opened end 306 of middle port 300 and into chamber 210. Thereafter, the fluid may flow downstream through conduit 112 to spray arm 180 where the fluid may be dispersed into wash chamber 106 to wash articles.

As further shown in FIG. 7, for this embodiment, main body 264 includes an upper tab 320 and a lower tab 322 protruding from main body 264 towards front portion 108 (FIG. 2) of wash chamber 106, e.g., along the transverse direction T. Upper tab 320 is positioned between upper port 280 and middle port 300, e.g., along the vertical direction V, and lower tab 322 is positioned between middle port 300 and lower port 290, e.g., along the vertical direction V. Upper tab 320 and lower tab 322 each include forward flanges 324, 326, respectively. When door 120 is closed and pushing on rack 130 causing conduit 112 to dock with docking station 260 (FIG. 2), the forward flanges 324, 326 of upper and lower tabs 320, 322 close any existing gap between sealing plate 230 and docking station 260 and each push or apply a forward force on rear surface 236 of sealing plate 230. In turn, forward surface 240 of rim 238 of sealing plate 230 is pressed firmly and flush with recessed face 218 of chamber 210. As such, sealing member 250 of sealing plate 230 (FIG. 5) is able to seal conduit 112 with docking station 260 to prevent leakage therefrom.

Figure 8:
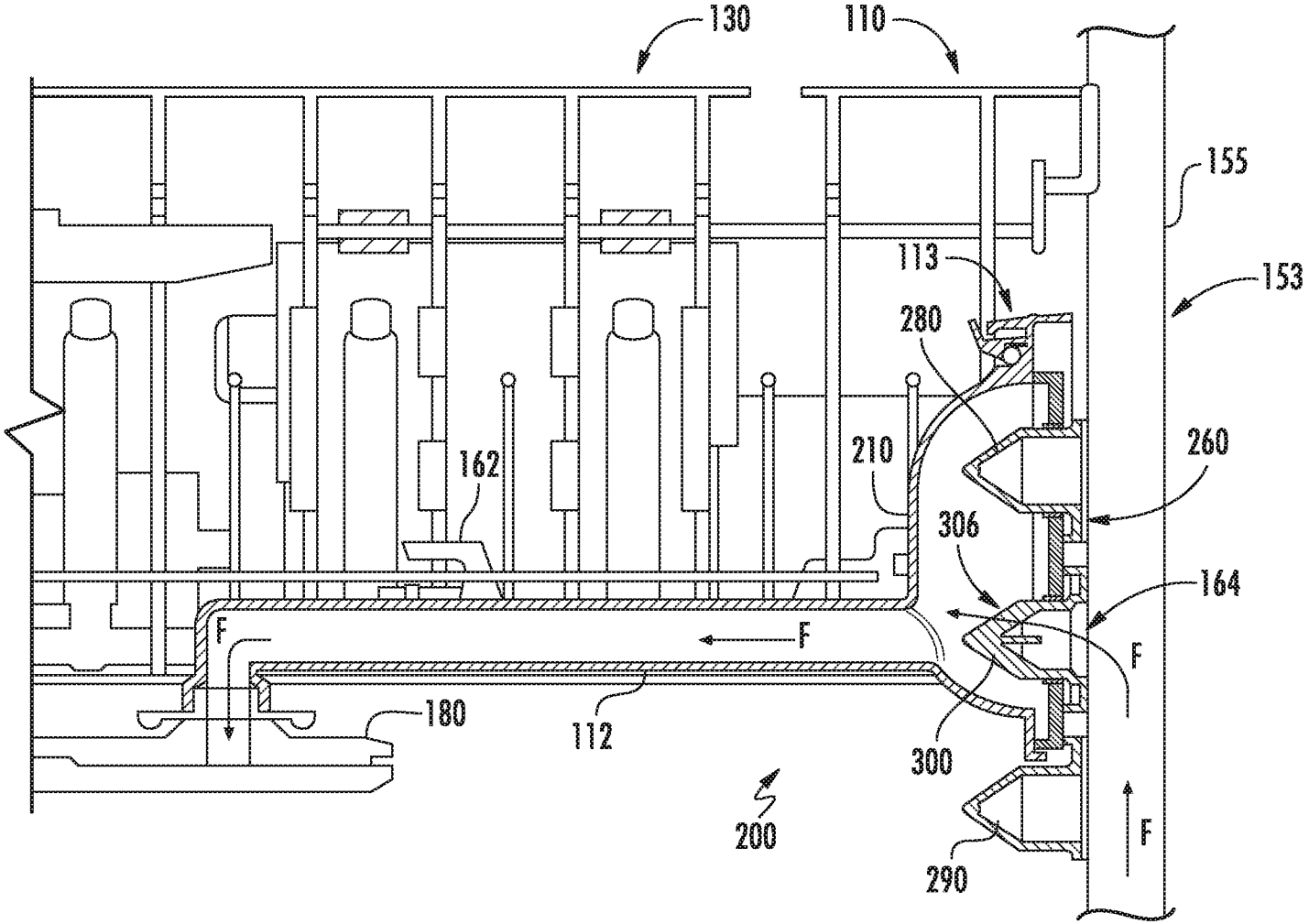
FIG. 8 provides a side, cross sectional view of the adjustable conduit and docking assembly of FIG. 3 in an upper position.
Figure 9:
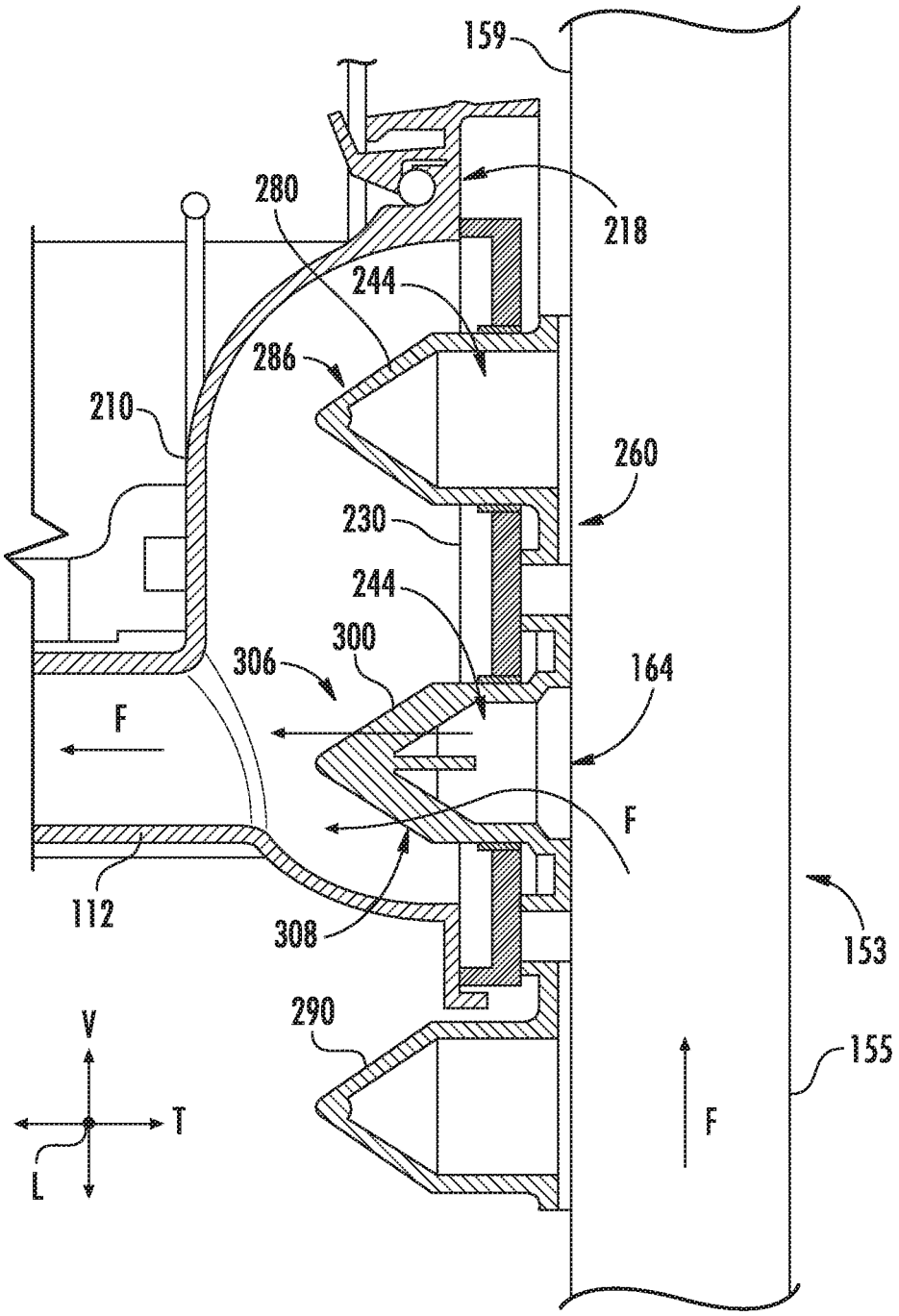
FIG. 9 provides a close up, cross sectional of Section 9 of FIG. 8.

FIGS. 8 and 9 provide various views of adjustable conduit and docking assembly 200 in an upper position or level. In particular, FIG. 8 provides a side, cross sectional view of adjustable conduit and docking assembly 200 in the upper position and FIG. 9 provides a close up, cross sectional of conduit 112 of the adjustable conduit and docking assembly 200 of FIG. 8 docked with docking station 260. As shown in FIG. 8, conduit 112 of adjustable conduit and docking assembly 200 is attached to upper rack assembly 130 via hooks 162 and snap lock 160. As such, to accommodate adjustment of rack assembly 130 to the upper position or level, conduit 112 is receivable with docking station 260 at an upper position, which is shown in FIGS. 8 and 9. For this embodiment, docking station 260 is positioned along fluid supply 153, e.g., vertically oriented conduit 155, such that egress 164 of fluid supply 153 and middle docking port 300 are in fluid communication, e.g. during operation of dishwasher appliance 100. Docking station 260 may be mounted to rear wall 157 of tub 104 (FIG. 2), for example.

As depicted for the exemplary embodiment of FIGS. 8 and 9, when conduit 112 is docked with docking station 260 in the upper position, lower aperture 244 receives middle docking port 300. As opened end 306 of middle docking port 300 includes a plurality of openings 308, fluid supply 153 is in fluid communication with conduit 112 via middle docking port 300. Accordingly, as shown by the arrows denoted by "F", during operation of dishwasher appliance 100, a flow of fluid may flow through egress 164 of fluid supply 153, through opened end 306 of middle docking port 300, into a lower portion of the interior volume of chamber 210, and downstream to spray arm 180 via conduit 112.

Further, when conduit 112 is docked with docking station 260 in the upper position, upper aperture 242 receives upper docking port 280. As closed end 286 of upper docking port 280 does not define any openings and there is no egress of fluid supply 153 that is in fluid communication with upper docking port 280, there is no fluid flow through upper docking port 280. Thus, upper docking port 280 facilitates docking of conduit 112 with docking station 260 and prevents fluid from exiting chamber 210 during operation of dishwasher appliance 100 but does not allow a fluid flow therethrough when conduit 112 is docked in the upper position. Moreover, as shown, when conduit 112 is docked with docking station 260 in the upper position, lower docking port 290 does not receive one of apertures 242, 244 of sealing plate 230. Thus, conduit 112 is not docked with lower docking port 290 when in the upper position.

In addition, when conduit 112 is docked with docking station 260 in the upper position, forward flange 324 of upper tab 320 and lower flange 326 of lower tab 322 are each pressed against and apply a forward force (i.e., a force toward front portion 108 of wash chamber 106; see FIG. 2) on rear surface 236 of sealing plate 230. More specifically, forward flange 324 of upper tab 320 is pressed against rear surface 236 of sealing plate 230 above middle docking port 300 and below upper docking port 280, e.g., along the vertical direction V. Forward flange 326 of lower tab 322 is pressed against rear surface 236 of sealing plate 230 below middle docking port 300 and above lower docking port 290, e.g., along the vertical direction V. When forward flange 324 of upper tab 320 and lower flange 326 of lower tab 322 are each pressed against and apply a forward force on rear surface 236 of sealing plate 230, forward surface 240 of rim 238 of sealing plate 230 is pressed firmly against and flush with recessed face 218 of chamber 210. Recessed face 218 thus applies a rearward force (i.e., a force toward rear portion 110 of wash chamber 106; see FIG. 8) on sealing plate 230. Accordingly, sealing plate 230 is sandwiched between tabs 320, 322 of docking station 260 and recessed face 218 of chamber 210. As such, sealing member 250 of sealing plate 230 (FIG. 5) is able to seal conduit 112 with docking station 260 to prevent leakage therefrom. In addition, when middle docking port 300 receives lower aperture 244, sealing member 248 disposed about lower aperture 244 seals against base protrusion 302 of middle docking port 300 to prevent leakage therefrom.

FIGS. 10 and 11 provide various views of adjustable conduit and docking assembly 200 in a lower position or level. In particular, FIG. 10 provides a side, cross sectional view of the adjustable conduit and docking assembly 200 in the lower position and FIG. 11 provides a close up, cross sectional of conduit 112 of the adjustable conduit and docking assembly 200 of FIG. 10 docked with docking station 260. To accommodate adjustment of rack assembly 130 to the lower position or level, conduit 112 is receivable with docking station 260 at a lower position, which is shown in FIGS. 10 and 11.

As shown in the depicted exemplary embodiment of FIGS. 10 and 11, when conduit 112 is docked with docking station 260 in the lower position, upper aperture 242 receives middle docking port 300. As opened end 306 of middle docking port 300 includes a plurality of openings 308, fluid supply 153 is in fluid communication with conduit 112 via middle docking port 300. Accordingly, as shown by the arrows denoted by "F", during operation of dishwasher appliance 100, a flow of fluid may flow through egress 164 of fluid supply 153, through opened end 306 of middle docking port 300, into an upper portion of the interior volume of chamber 210, and downstream to spray arm 180 via conduit 112.

Moreover, when conduit 112 is docked with docking station 260 in the lower position, lower aperture 244 receives lower docking port 290. As closed end 296 of lower docking port 290 does not define any openings and there is no egress of fluid supply 153 that is in fluid communication with lower docking port 290, there is no fluid flow through lower docking port 290. Thus, lower docking port 290 facilitates docking of conduit 112 with docking station 260 and prevents fluid from exiting chamber 210 during operation of dishwasher appliance 100 but does not allow a fluid flow therethrough when conduit 112 is docked in the lower position. Moreover, as shown, when conduit 112 is docked with docking station 260 in the lower position, upper docking port 280 does not receive one of apertures 242, 244 of sealing plate 230. Thus, conduit 112 is not docked with upper docking port 280 when in the lower position.

Furthermore, when conduit 112 is docked with docking station 260 in the lower position, forward flange 324 of upper tab 320 and lower flange 326 of lower tab 322 are each pressed against and apply a forward force (i.e., a force toward front portion 108 of wash chamber 106; see FIG. 2) on rear surface 236 of sealing plate 230. When forward flange 324 of upper tab 320 and lower flange 326 of lower tab 322 are each pressed against and apply a forward force on rear surface 236 of sealing plate 230, forward surface 240 of rim 238 of sealing plate 230 is pressed firmly against and flush with recessed face 218 of chamber 210. Recessed face 218 thus applies a rearward force (i.e., a force toward rear portion 110 of wash chamber 106; see FIG. 10) on sealing plate 230. Accordingly, sealing plate 230 is sandwiched between tabs 320, 322 of docking station 260 and recessed face 218 of chamber 210. As such, sealing member 250 of sealing plate 230 (FIG. 5) is able to seal conduit 112 with docking station 260 to prevent leakage therefrom. In addition, when middle docking port 300 receives upper aperture 242, sealing member 246 disposed about upper aperture 242 seals against base protrusion 302 of middle docking port 300 to prevent leakage therefrom.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a cabinet defining a wash chamber for a receipt of articles for washing;

a rack for carrying the articles, the rack configured for movement between a retracted position and an extended position and configured for adjustment between an upper position and a lower position within the wash chamber;

a fluid supply located along a rear portion of the wash chamber and defining an egress for a flow of fluid out of the fluid supply;

a conduit attached to the rack and movable with the rack between the retracted position and the extended position as well as between the upper position and the lower position, the conduit having a connecting end;

a chamber positioned at the connecting end of the conduit and defining an opening;

a sealing plate positioned at the opening of the chamber and defining an upper aperture and a lower aperture; and a docking station attached to the fluid supply, the docking station having an upper docking port, a middle docking port, and a lower docking port, the upper aperture and the lower aperture of the sealing plate each configured to receive one of the upper, middle, and lower docking ports when the rack is in the retracted position, and wherein the middle docking port has an opened end to permit a flow of fluid through the egress and into the conduit when the rack is in the retracted position and wherein the upper docking port and the lower docking port each have a closed end to prevent a flow of fluid into the conduit when the rack is in the retracted position.

2. The dishwasher appliance of claim 1, wherein when the rack is in the retracted position and in the upper position, the upper aperture of the sealing plate receives the upper docking port and the lower aperture of the sealing plate receives the middle docking port.

3. The dishwasher appliance of claim 1, wherein when the rack is in the retracted position and in the lower position, the upper aperture of the sealing plate receives the middle docking port and the lower aperture of the sealing plate receives the lower docking port.

4. The dishwasher appliance of claim 1, wherein the sealing plate comprises a sealing member disposed about the upper aperture.

5. The dishwasher appliance of claim 1, wherein the sealing plate comprises a sealing member disposed about the lower aperture.

6. The dishwasher appliance of claim 1, wherein the upper docking port, the middle docking port, and the lower docking port each comprise a base protrusion and a conical protrusion extending from the base protrusion.

7. The dishwasher appliance of claim 1, wherein the middle docking port defines a plurality of openings at its opened end.

8. The dishwasher appliance of claim 1, wherein the docking station comprises a housing having a main body, an upper tab protruding from the main body of the housing, and a lower tab protruding from the main body of the housing, and wherein the upper tab is positioned between the upper docking port and the middle docking port and the lower tab is positioned between the middle docking port and the lower docking port, and wherein the upper tab comprises a forward flange and the lower tab comprises a forward flange, and wherein when the rack is in the retracted position the forward flange of the upper tab and the forward flange of the lower tab apply a force on a rear surface of the sealing plate.

9. The dishwasher appliance of claim 1, further comprising:

a tub positioned within the cabinet and having a rear wall, and wherein the fluid supply extends vertically along the rear wall of the tub and within the wash chamber.

10. The dishwasher appliance of claim 1, wherein the conduit is connected to a spray arm.

11. The dishwasher appliance of claim 1, wherein the chamber is integrally formed with the conduit.

12. The dishwasher appliance of claim 1, wherein the docking station comprises a housing having a main body, and wherein the upper docking port protrudes from the main body of the housing, the middle docking port protrudes from the main body of the housing, and the lower docking port protrudes from the main body of the housing, and wherein the middle docking port is positioned between the upper docking port and the lower docking port.

* * * * *